US008843050B2

(12) United States Patent
Fukushima et al.

(10) Patent No.: US 8,843,050 B2
(45) Date of Patent: Sep. 23, 2014

(54) DRIVE UNIT, IMAGE FORMING APPARATUS INCLUDING SAME, AND DRIVING METHOD THEREFOR

(75) Inventors: Tatsuo Fukushima, Osaka (JP); Mizuna Tanaka, Osaka (JP); Kunihiko Nishioka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 827 days.

(21) Appl. No.: 13/064,804

(22) Filed: Apr. 18, 2011

(65) Prior Publication Data

US 2011/0280626 A1 Nov. 17, 2011

(30) Foreign Application Priority Data

May 11, 2010 (JP) ..... 2010-109316
Mar. 29, 2011 (JP) ..... 2011-072564

(51) Int. Cl.
*G03G 21/12* (2006.01)
*G03G 15/00* (2006.01)
*G03G 15/16* (2006.01)

(52) U.S. Cl.
CPC ..... *G03G 21/12* (2013.01); *G03G 15/1605* (2013.01); *G03G 15/757* (2013.01); *G03G 15/5008* (2013.01)
USPC ..... 399/360; 399/167

(58) Field of Classification Search
USPC ..... 74/405; 399/167, 236, 258, 360; 271/264
See application file for complete search history.

(56) References Cited

U.S. PATENT DOCUMENTS

| | | | | |
|---|---|---|---|---|
| 4,316,719 | A | 2/1982 | Motomura et al. | |
| 4,362,502 | A | 12/1982 | Motomura et al. | |
| 4,386,539 | A | 6/1983 | Motomura et al. | |
| 4,591,261 | A * | 5/1986 | Saruwatari et al. | 399/167 |
| 5,428,431 | A | 6/1995 | Abe et al. | |
| 7,853,178 | B2 * | 12/2010 | Foster et al. | 399/167 |
| 7,869,750 | B2 | 1/2011 | Hanashima et al. | |
| 2008/0217834 | A1 | 9/2008 | Sasahara | |

(Continued)

FOREIGN PATENT DOCUMENTS

| | | |
|---|---|---|
| JP | 56-1065 | 1/1981 |
| JP | 4247278 A | 9/1992 |

(Continued)

OTHER PUBLICATIONS

Abstract of JP 2005-035034 published Feb. 10, 2005.

(Continued)

*Primary Examiner* — Hoang Ngo
(74) *Attorney, Agent, or Firm* — Harness, Dickey & Pierce, P.L.C.

(57) ABSTRACT

An image forming apparatus includes an image forming unit, first and second rotary shafts, a drive source to rotate at a predetermined low velocity and a predetermined high velocity, a first rotary transmitter connected between the drive force and the first rotary shaft, a second rotary transmitter connected between the drive force and the second rotary shaft, and a drive block member connected between the drive source and the second rotary shaft to block transmission of the drive force to the second rotary shaft when the drive source rotates at the predetermined high velocity. When the drive source rotates at the predetermined low velocity, the drive source drives the second rotary shaft using a difference in torque between an upper limit in high velocity rotation and an upper limit in low velocity rotation greater than the upper limit in high velocity rotation.

20 Claims, 7 Drawing Sheets

(56) References Cited

U.S. PATENT DOCUMENTS

| | | | |
|---|---|---|---|
| 2008/0226352 | A1 | 9/2008 | Tanaka et al. |
| 2008/0226358 | A1 | 9/2008 | Hanashima et al. |
| 2010/0192710 | A9 | 8/2010 | Hanashima et al. |
| 2011/0052261 | A1 | 3/2011 | Fukushima et al. |
| 2011/0058847 | A1 | 3/2011 | Furuichi et al. |

FOREIGN PATENT DOCUMENTS

| | | | |
|---|---|---|---|
| JP | 6-239489 | | 8/1994 |
| JP | 4010835 | A | 10/2003 |
| JP | 2005035034 | A | 2/2005 |
| JP | 2006114194 | A | 4/2006 |
| JP | 4247279 | A | 8/2008 |
| JP | 2009091855 | A | 4/2009 |

OTHER PUBLICATIONS

Abstract of JP 2006-114194 published Apr. 27, 2006.
Absract of JP 2008-196742 published Aug. 28, 2008.
Abstract of JP 2003-278441 published Oct. 2, 2003.
Abstract of JP 2008-196743 published Aug. 28, 2008.
Abstract of JP 2009-091855 published Apr. 30, 2009.
Chinese Office Action mailed Jul. 3, 2013.

* cited by examiner

DRIVE UNIT, IMAGE FORMING APPARATUS INCLUDING SAME, AND DRIVING METHOD THEREFOR

CROSS-REFERENCE TO RELATED APPLICATIONS

This patent specification is based on and claims priority from Japanese Patent Application Nos. 2010-109316, filed on May 11, 2010, and 2011-072564, filed on Mar. 29, 2011 in the Japan Patent Office, which are hereby incorporated by reference herein in its entirety.

BACKGROUND OF THE INVENTION

1. Field of the Invention

The present invention generally relates to a drive unit, an image forming apparatus, such as a copier, a printer, a facsimile machine, or a multifunction machine including at least two of these functions, that includes the drive unit, and a driving method therefor.

2. Discussion of the Background Art

Generally, motors (i.e., drive sources) used in electrophotographic image forming apparatuses are required to rotate at multiple different velocities corresponding to the operational mode of the image forming apparatus, which in turn depends on image quality and recording media type. Accordingly, margin of allowable torque is dependent on the velocity. That is, when the velocity is lower, the margin is greater, thus increasing adverse effects such as heat generation or vibration. To avoid such adverse effects, several approaches described below have been tried.

For example, the electrical current for the motor may be adjusted to reduce the margin of allowable torque. More specifically, pulse-width modulation (PWM) control is used, or the channel is switched for each threshold of the electrical current. These approaches, however, have several drawbacks. For example, the capacity of the software required for the control and the number of control-related components increase. Consequently, the required space as well as the cost increases.

Alternatively, inrush electrical current may be controlled by resistors having multiple fixed resistances to reduce the margin of allowable torque. However, it is difficult to switch the fixed resistance on the driving source. Additionally, the number of control-related components, the required space, and the cost increase similarly to the first approach described above. Thus, it is difficult to provide a compact image forming apparatus at a reduced cost.

In view of the foregoing, for example, JP-2003-278441-A proposes a direct current (DC) motor that includes a low-velocity brush, a high-velocity brush, and a common brush, and a control circuit switches the brush between the low-velocity brush and the high-velocity brush depending on the velocity. The DC motor rotates at high velocity with a lower torque when the common brush and the high-velocity brush are activated and rotates at low velocity with a higher torque when the common brush and the low-velocity brush are activated.

SUMMARY OF THE INVENTION

In view of the foregoing, one illustrative embodiment of the present invention provides an image forming apparatus that includes an image forming unit including an image bearer on which images are formed and a development device to develop the image formed on the image bearer, a first rotary shaft, a second rotary shaft, a drive unit to drive the first and second rotary shafts. The drive unit includes a drive source that rotates at a predetermined low velocity and a predetermined high velocity, a first rotary transmitter connected between the drive force and the first rotary shaft to transmit the drive force to the first rotary shaft, a second rotary transmitter connected between the drive force and the second rotary shaft to transmit the drive force to the second rotary shaft, and a drive block member connected between the drive source and the second rotary shaft to block transmission of the drive force to the second rotary shaft when the drive source rotates at the predetermined high velocity. When the drive source rotates at the predetermined low velocity, the drive unit drives the second rotary shaft using a difference in torque of the drive source between an upper limit torque in high velocity rotation and an upper limit torque in low velocity rotation, greater than the upper limit torque in high velocity rotation.

Another illustrative embodiment of the present invention provides an image forming apparatus that includes the above-described image forming unit, a drive unit, and a driven unit that is driven at multiple different velocities and requires a greater torque when a velocity thereof is lower than when the velocity thereof is higher. The drive unit includes a drive source to rotate at a predetermined low velocity and a predetermined high velocity, and a drive transmission unit, connected between the drive source and the driven unit, to transmit a drive force from the drive source to the driven unit. When the drive source rotates at the predetermined low velocity, the drive unit drives the driven unit using a difference in torque of the drive source between an upper limit torque in high velocity rotation and an upper limit torque in low velocity rotation, greater than the upper limit torque in high velocity rotation.

Yet another illustrative embodiment of the present invention provides a method of driving a driven unit requiring a greater torque when a velocity thereof is lower than when the velocity thereof is high by a drive source rotatable at a predetermined low velocity and a predetermined high velocity. The method includes a step of rotating the drive source at the predetermined low velocity, a step of transmitting a drive force from the drive source to the driven unit, and a step of driving the driven unit using a difference in torque of the drive source between an upper limit torque in high velocity rotation and an upper limit torque in low velocity rotation greater than the upper limit torque in high velocity rotation when the drive source rotates at the predetermined low velocity.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
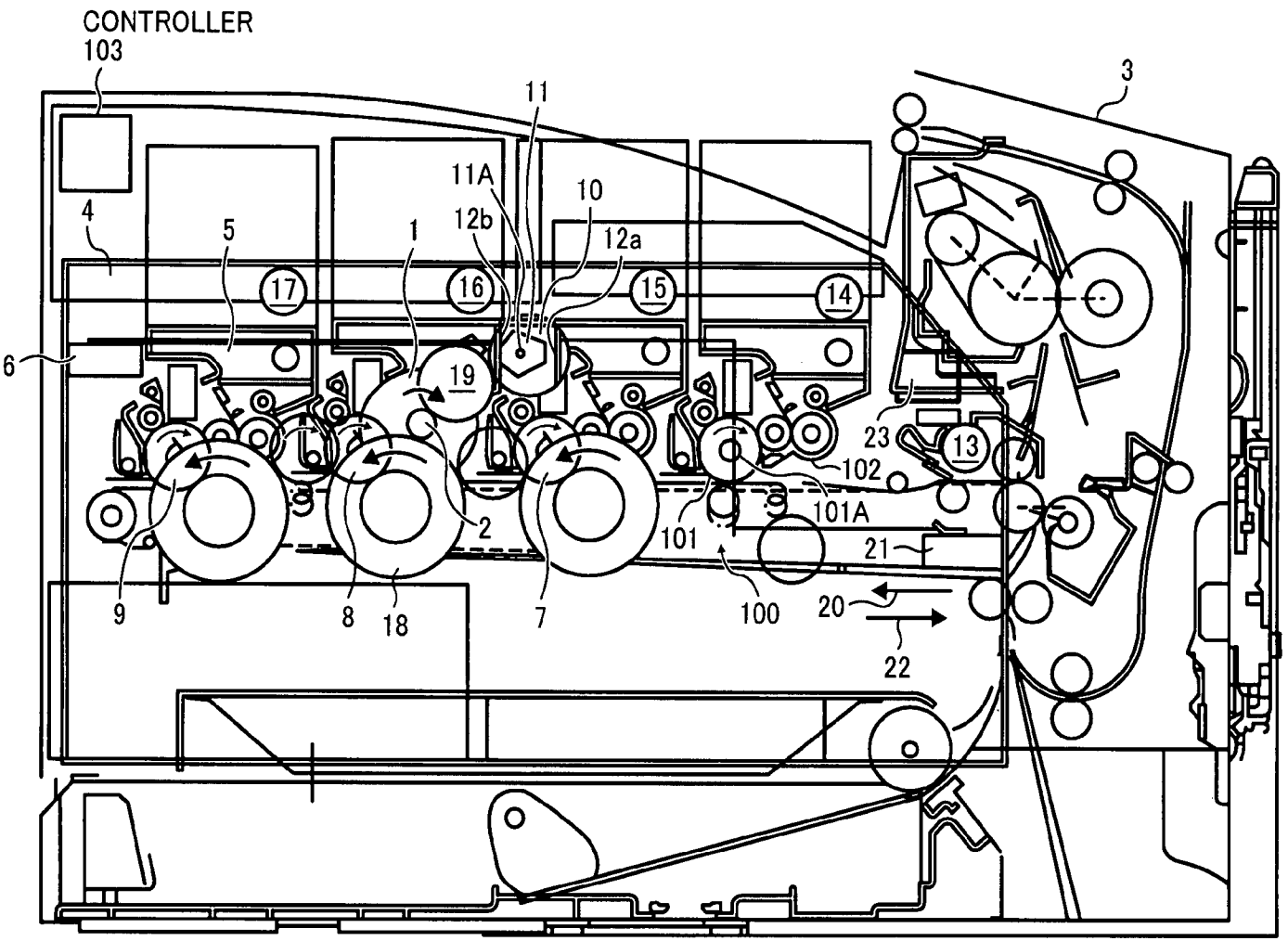
FIG. 1 is a cross-sectional view that illustrates configurations of an image forming apparatus according to a first embodiment and a drive transmission mechanism used therein.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to a first embodiment of the present invention is described. It is to be noted that the reference characters C, M, Y, and Bk represent cyan, magenta, yellow, and black, respectively, and the reference characters including one of them represent components used for forming that color of images. These color reference characters may be omitted when color discrimination is not necessary.

First Embodiment

Figure 2:
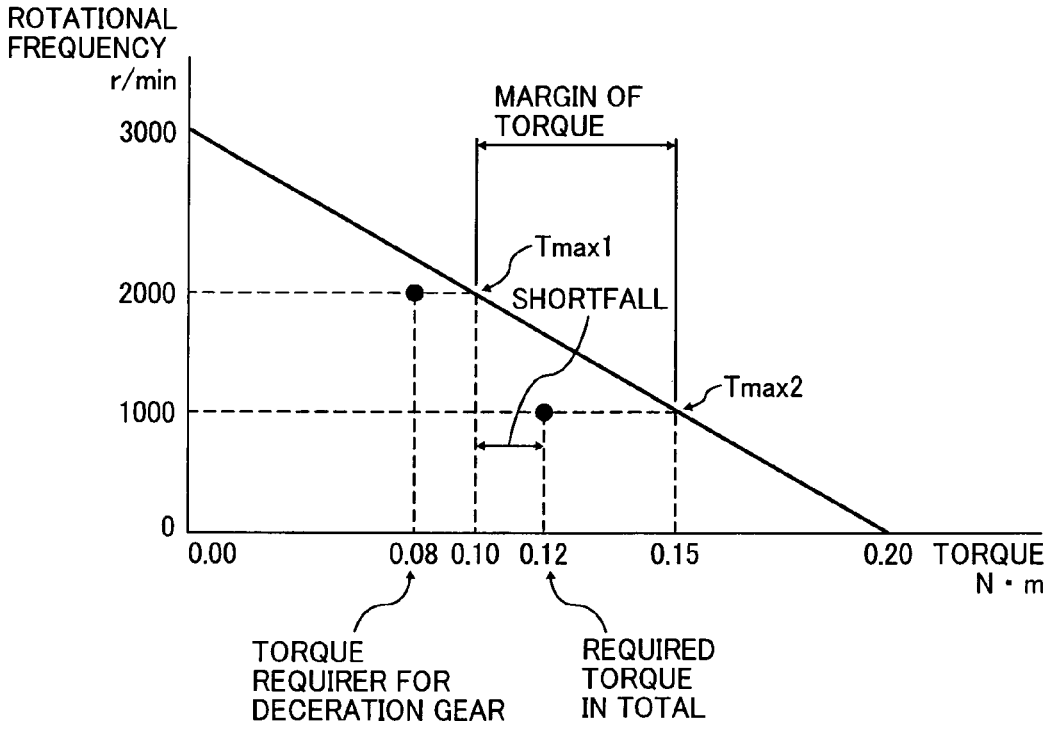
FIG. 2 is a graph that illustrates the relation between torque and frequency of rotation of a drive source that is a brush motor, a brushless motor, or a stepping motor.
Figure 3:
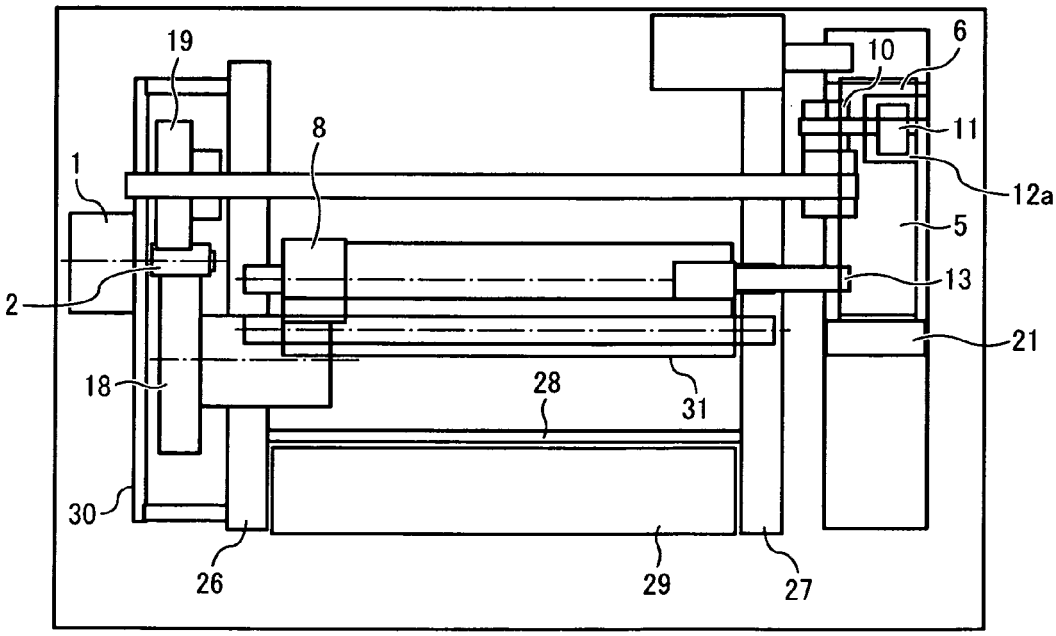
FIG. 3 is a side view of the drive transmission mechanism of the image forming apparatus shown in FIG. 1.

FIG. 1 is a diagram that illustrates configurations of the image forming apparatus according to the first embodiment and a drive transmission mechanism used therein, and FIG. 2 is a graph that illustrates the relation between torque and frequency of rotation of a drive source that may be a brush motor, a brushless motor, or a stepping motor. FIG. 3 is a side view of the drive transmission mechanism of the image forming apparatus shown in FIG. 1. It is to be noted that, in FIG. 2, reference characters Tmax1 and Tmax2 represent a maximum torque in a high-velocity mode and in a low-velocity mode of a drive source 1.

In the configuration shown in FIG. 1, the image forming apparatus 3 is a tandem image forming apparatus that includes image forming units 100 for forming yellow, cyan, magenta, and black images, respectively, each including an image bearer 101, such as a photoreceptor, and a development unit 102. The image forming apparatus 3 further includes the drive source 1, a rotary shaft 2 of the drive source 1, a yellow image bearer gear 7, a magenta image bearer gear 8, a cyan image bearer gear 9, a magenta deceleration gear 18, a waste toner container 4, an electromagnetic clutch 19, and an agitator drive gear 10. The yellow, magenta, and cyan image bearer gears 7, 8, and 9 are coaxial with the image bearers 101Y, 101C, and 101M, respectively, and serve as first rotary drive transmitters. That is, shafts 101A of the image bearers 101Y, 101C, and 101M together form a group of first rotary shafts, and the image bearer gears 7, 8, and 9 are respectively fixed to the shafts 101A of the image bearers 101Y, 101C, and 101M. The rotary shaft 2 is connected to the yellow, magenta, and cyan image bearer gears 7, 8, and 9 via the magenta deceleration gear 18. The yellow and cyan image bearer gears 7 and 9 may be connected via respective deceleration gears and idler gears to the magenta deceleration gear 18.

The rotary shaft 2 is also connected via the electromagnetic clutch 19 to the agitator drive gear 10 that is fixed to a cam shaft 11A, serving as a second rotary shaft, provided at the waste toner container 4. The agitator drive gear 10 serves as a second rotary drive transmitter, and the electromagnetic clutch 19 serves as a drive block member to block transmission of a drive force to the second rotary shaft.

The image forming apparatus 3 further includes a controller 103 operatively connected to the drive unit including the drive source 1 and the drive transmission mechanism. It is to be noted that, in FIG. 3, reference numeral 26 represents a left frame, 27 represents a right frame, 28 represents a bottom plate, 29 represents a sheet cassette, 30 represents a bracket, and 31 represents an intermediate transfer unit.

Inside the waste toner container 4, cam sliders 12*a* and 12*b* mounted on agitator supports 6 and 21 united with the waste toner container 4, a planar waste toner agitator 5 connected to the cam sliders 12*a* and 12*b*, a cam 11 provided coaxially with the agitator drive gear 10, a waste toner outlet 13 for waste toner collected from a transfer belt of the intermediate transfer unit 31, a waste black toner outlet 14, a waste yellow toner outlet 15, a waste magenta toner outlet 16, and a waste cyan toner outlet 17 are provided. Waste toner is discharged from the waste toner outlet 13, the waste black toner outlet 14, the waste yellow toner outlet 15, the waste magenta toner outlet 16, and the waste cyan toner outlet 17 after image formation. The image forming apparatus 3 further includes a waste toner amount detector 23 to detect whether the waste toner container 4 is filled to capacity with waste toner.

If not leveled, the discharged waste toner accumulates unevenly in the waste toner container 4. Accordingly, it is possible that the unevenly accumulating waste toner overflows outside the waste toner container 4 before the waste toner amount detector 23 detects that the waste toner container 4 is full. Also, it is possible that the ti waste toner outlet 13 14, 15, 16, or 17 is clogged with the waste toner, preventing discharge of the waste toner to the waste toner container 4. Therefore, the waste toner is agitated in the waste toner container 4 by the waste toner agitator 5 using the cam 11. The waste toner can be leveled by the waste toner agitator 5 so that the waste toner container 4 is filled to capacity with the waste toner and the waste toner amount detector 23 can detects that.

When the drive source 1 is rotated clockwise in FIG. 1 at a higher velocity of, for example, 2000 revolutions per minute (rpm) in a high-velocity mode, a maximum allowable torque of the drive source 1 is 0.1 N·m as shown in FIG. 2 and is greater than 0.08 N·m, which is a torque required to drive the magenta deceleration gear 18. However, in the high-velocity mode, the maximum torque is insufficient for simultaneously driving the magenta deceleration gear 18 and the cam 11 via the electromagnetic clutch 19 although it is preferred. That is, the sum of the torque required to drive the magenta deceleration gear 18 (0.08 N·m) and the torque required to drive the cam 11 via the electromagnetic clutch 19 (0.04 N·m) is 0.12 N·m, greater than the maximum torque of 0.1 N·m. Further, in the low-velocity mode, vibration and heat are generated as the maximum torque of the drive source 1 increases, which is not desirable.

In view of the foregoing, the cam 11 is connected to the waste toner agitator 5 via the cam sliders 12*a* and 12*b*, and, in the low-velocity mode, the cam 11 is driven using the increase in the maximum torque of the drive source 1 to agitate the waste toner in the waste toner container 4 in the present embodiment.

Driving of the cam 11 in the low-velocity mode is described in further detail below.

In the high-velocity mode, power supply to the electromagnetic clutch 19 is stopped and the group of first rotary shafts only is driven via the magenta deceleration gear 18. By contrast, when the drive source 1 is rotated at a lower velocity of, for example, 1000 rpm clockwise in the low-velocity mode, power is supplied to the electromagnetic clutch 19. At that time, the maximum torque of the drive source 1 in low velocity rotation is 0.15 N·m as shown in FIG. 2 and is greater than the sum, 0.12 N·m, of the torque required to drive the magenta deceleration gear 18 (0.08 N·m) and the torque required to drive the cam 11 via the electromagnetic clutch 19 (0.04 N·m).

At that time, the cam 11 rotates clockwise and contacts the cam slider 12*a*, and accordingly the waste toner agitator 5 moves linearly in the direction indicated by arrow 22 shown in FIG. 1 (hereinafter "agitator travel direction 22"). Additionally, when the cam 11 contacts the cam slider 12*b*, the waste toner agitator 5 moves linearly in the direction indicated by arrow 20 shown in FIG. 1 (hereinafter "agitator travel direction 20"). When the cam 11 is kept rotating, the waste toner agitator 5 moves reciprocally in the linear agitator travel directions 20 and 22.

With this movement, the waste toner in the waste toner container 4 is agitated and can be leveled, securing the capacity of the waste toner container 4. It is to be noted that the drive source 1 is rotated at the lower velocity when high quality images are formed (low-velocity mode or high quality mode) and at the higher velocity when standard quality images are formed (high-velocity mode or standard quality mode). In such a case, the waste toner is not agitated unless high quality images are formed. Therefore, after image position adjustment, which is executed at given constant intervals, the velocity of the drive source 1 is switched to the lower velocity and the cam 11 is driven, thus agitating the waste toner. Additionally, during the low-velocity mode (high quality mode), keeping the cam 11 driven constantly enables waste toner agitation without increasing the maximum output of the drive source 1 and can restrict the torque margin, which tends to increase in the low-velocity mode. As a result, generation of vibration and heat can be inhibited.

As described above, in the first embodiment, the rotary shaft 2 provided at the drive source 1 is connected to the gears 7, 8, and 9, serving as the first drive transmitters connected to the shafts 101A, serving as the first rotary shafts, of yellow, magenta, and cyan image bearers 101. The rotary shaft 2 is also connected via the electromagnetic clutch 19 (drive block member) to the agitator drive gear 10, serving as the second drive transmitters connected to the cam shaft 11A, serving as the second rotary shaft, provided at the waste toner container 4. When the drive source 1 rotates at a high velocity, the electromagnetic clutch 19 blocks transmission of the drive force to the second rotary shaft via the agitator drive gear 10, and only the first rotary shafts are driven via the image bearer gears 7, 8, and 9. When the drive source 1 rotates at the low velocity, the first rotary shafts (image bearer gears 7, 8, and 9) are driven, the agitator drive gear 10 is driven using the difference between the upper limit torque of the drive source 1 at the high velocity and that at the low velocity greater than the upper limit torque of the drive source 1 at the high velocity. Thus, the margin of torque is reduced, restricting generation of heat and vibration.

Second Embodiment

Figure 4:
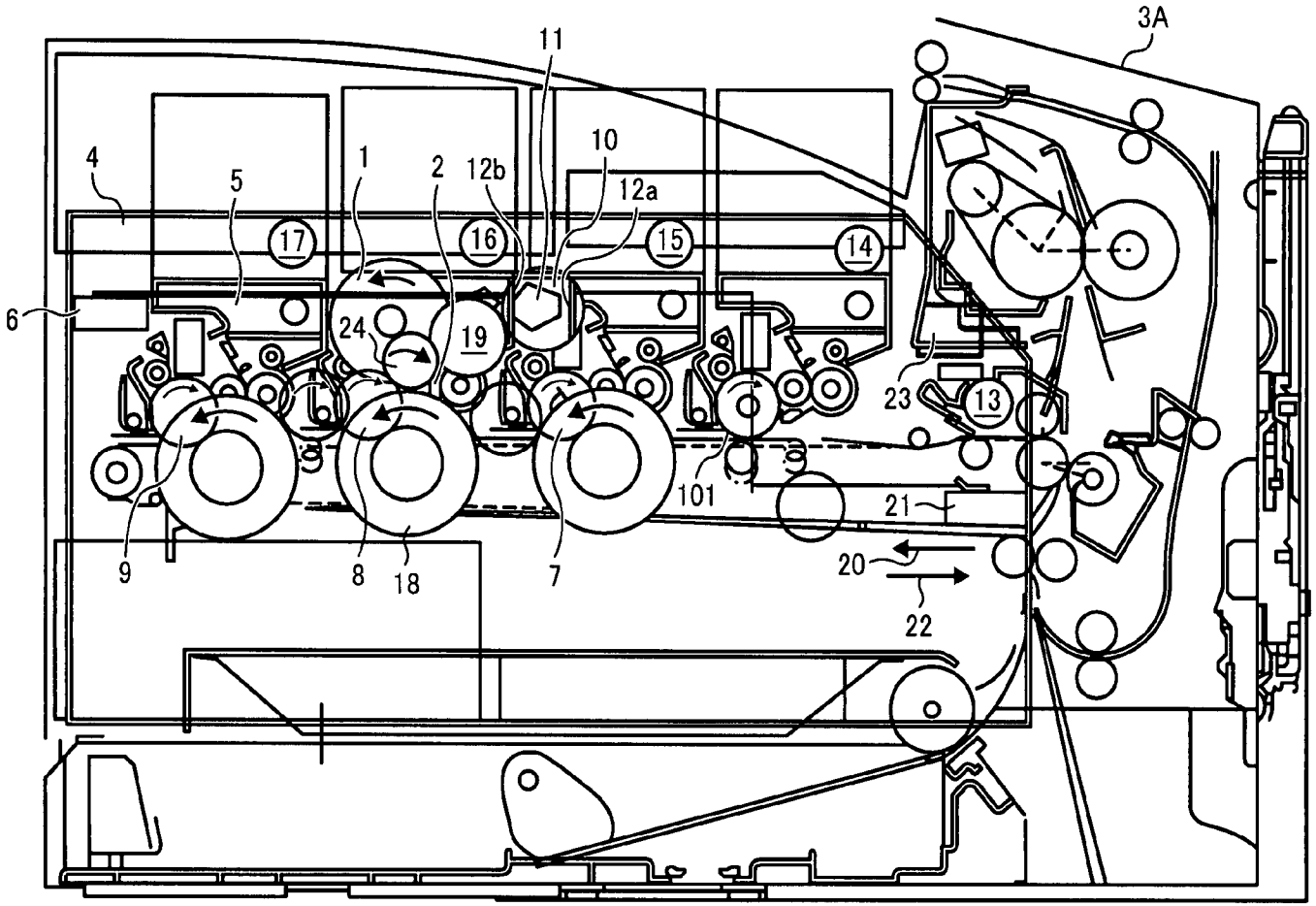
FIG. 4 is a cross-sectional view that illustrates configurations of an image forming apparatus according to a second embodiment and a drive transmission mechanism used therein.

FIG. 4 is a cross-sectional view that illustrates configurations of an image forming apparatus according to a second embodiment and a drive transmission mechanism used therein. In FIG. 4, the drive source 1 rotates counterclockwise. The second embodiment is described below with reference to FIG. 2 in addition to FIG. 4.

In the configuration shown in FIG. 4, an image forming apparatus 3A includes a drive source 1, a rotary shaft 2 provided at the drive source 1, image bearers 101, such as photoreceptors, for yellow, cyan, magenta, and black, and yellow, magenta, and cyan image bearer gears 7, 8, and 9, a magenta deceleration gear 18, a waste toner container 4, an electromagnetic clutch 19, and an agitator drive gear 10. The yellow, magenta, and cyan image bearer gears 7, 8, and 9 are respectively coaxial with the image bearers 101 for yellow, cyan, and magenta that are first rotary shafts. The image forming apparatus 3A further includes an idler gear 24, and the rotary shaft 2 is connected to the yellow, magenta, and cyan image bearer gears 7, 8, and 9 via the idler gear 24 and the deceleration gear 18. The rotary shaft 2 is also connected via the idler gear 24 and the electromagnetic clutch 19 to the agitator drive gear 10 is provided at the waste toner container 4 and serves as a second drive transmitter connected to a second rotary shaft. Also in the present embodiment, to restrict generation of vibration and heat due to the increase in the maximum torque of the drive source 1 in the low-velocity mode, the cam 11 is driven using the increase in the maximum torque of the drive source 1 to agitate the waste toner in the waste toner container 4.

In the high-velocity mode, power supply to the electromagnetic clutch 19 is stopped and the group of first rotary shafts only is driven via the idler gear 24 as well as the magenta deceleration gear 18. When the drive source 1 is rotated at a lower velocity of, for example, 1000 rpm counterclockwise in FIG. 4 in the low-velocity mode, power is supplied to the electromagnetic clutch 19. Then, the maximum torque of the drive source 1 is 0.15 N·m as shown in FIG. 2 and greater than the sum, 0.12 N·m, of the torque required to drive the magenta deceleration gear 18 via the idler gear 24 (0.08 N·m) and the torque required to drive the cam 11 via the idler gear 24 (0.04 N·m).

At that time, the cam 11 rotates clockwise and contacts the cam slider 12*a*, and accordingly the waste toner agitator 5 moves linearly in the agitator travel direction 22. Additionally, when the cam 11 contacts the cam slider 12*b*, the waste toner agitator 5 moves linearly in the agitator travel direction 20. When the cam 11 is kept rotating, the waste toner agitator 5 moves reciprocally in the agitator travel directions 20 and 22. With this movement, the waste toner in the waste toner container 4 is agitated and can be leveled, to achieve full use of the capacity of the waste toner container 4. It is to be noted that the drive source 1 enters the low-velocity mode to form high quality images and the high-velocity mode to form standard quality images. In such a case, the waste toner is not agitated unless high quality images are formed. Therefore, after image position adjustment, which is executed at given constant intervals, the velocity of the drive source 1 is switched to the lower velocity and the cam 11 is driven, thus agitating the waste toner. Additionally, during the low-velocity mode (high quality mode), keeping the cam 11 driven constantly enables waste toner agitation without increasing the maximum output of the drive source 1 and can restrict the torque margin, which tends to increase in the low-velocity mode. As a result, generation of vibration and heat can be inhibited.

Third Embodiment

Figure 5:
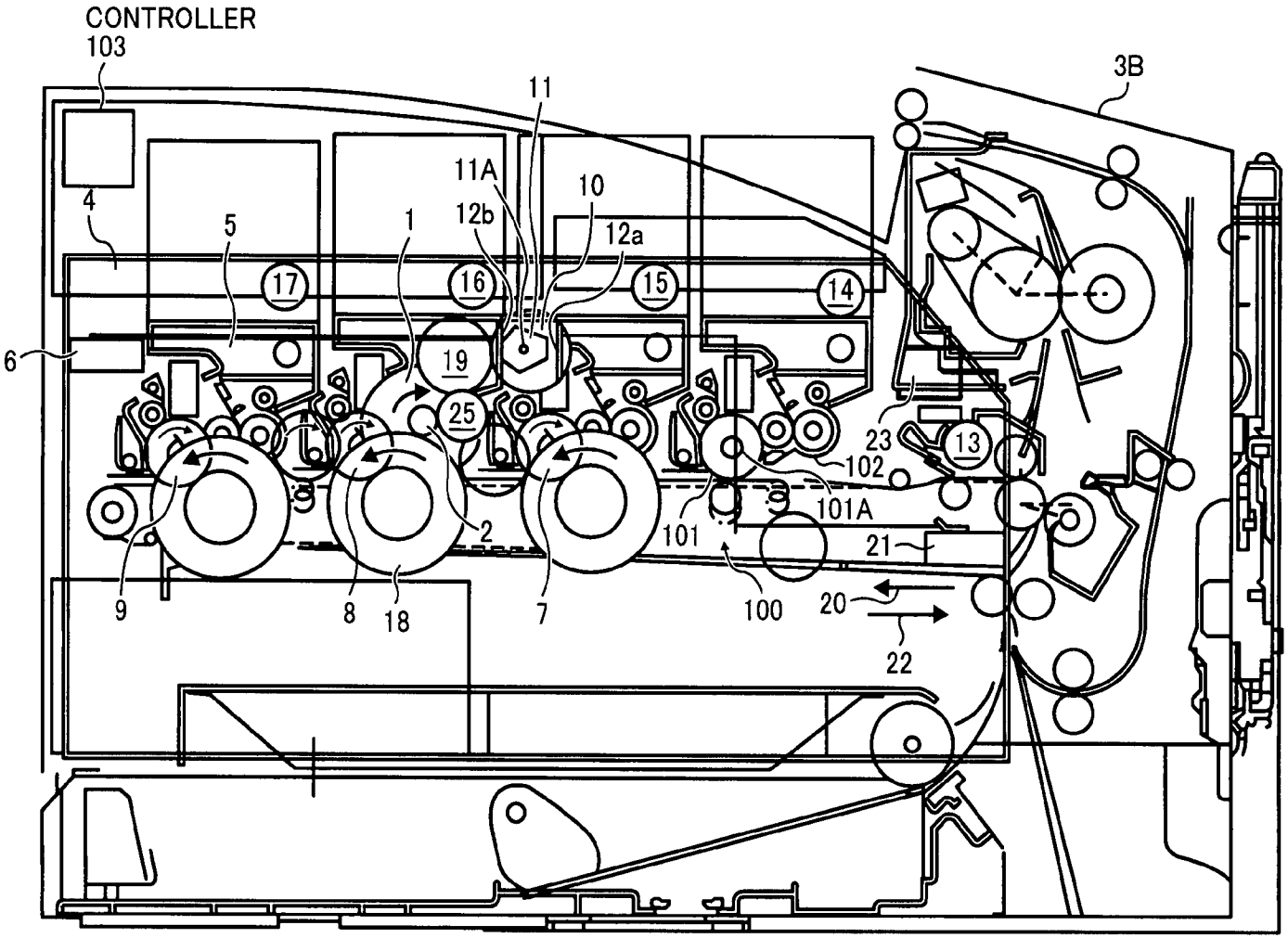
FIG. 5 is a cross-sectional view that illustrates configurations of an image forming apparatus according to a third embodiment and a drive transmission mechanism used therein.

FIG. 5 is a cross-sectional view that illustrates configurations of an image forming apparatus according to a third embodiment and a drive transmission mechanism used therein. In FIG. 5, the agitator drive gear 10 rotates counterclockwise. The third embodiment is described below with reference to FIG. 2 in addition to FIG. 5.

In the configuration shown in FIG. 5, an image forming apparatus 3B includes a drive source 1, a rotary shaft 2 provided at the drive source 1, image bearers 101, such as photoreceptors, for yellow, cyan, magenta, and black, and yellow, magenta, and cyan image bearer gears 7, 8, and 9, a magenta deceleration gear 18, a waste toner container 4, an electromagnetic clutch 19, and an agitator drive gear 10. The yellow, magenta, and cyan image bearer gears 7, 8, and 9 are respectively coaxial with the image bearers 101 for yellow, cyan, and magenta that are first rotary shafts. The rotary shaft 2 is connected to the yellow, magenta, and cyan image bearer gears 7, 8, and 9 via the deceleration gear 18. The rotary shaft 2 is also connected via an idler gear 25 and the electromagnetic clutch 19 to the agitator drive gear 10 that is provided at the waste toner container 4 and serves as a second drive transmitter connected to a second rotary shaft. Also in the present embodiment, to restrict generation of vibration and heat due to the increase in the maximum torque of the drive source 1 in the low-velocity mode, the cam 11 is driven using the increase in the maximum torque of the drive source 1 to agitate the waste toner in the waste toner container 4.

In the high-velocity mode, power supply to the electromagnetic clutch 19 is stopped and the group of first rotary shafts only is driven via the magenta deceleration gear 18. When the drive source 1 is rotated at a lower velocity of, for example, 1000 rpm clockwise in the low-velocity mode, power is supplied to the electromagnetic clutch 19. Then, the maximum torque of the drive source 1 is 0.15 N·m as shown in FIG. 2 and is greater than the sum, 0.12 N·m, of the torque required to drive the magenta deceleration gear 18 (0.08 N·m) and the torque required to drive the cam 11 via the idler gear 25 (0.04 N·m).

At that time, the cam 11 rotates clockwise and contacts the cam slider 12*a*, and accordingly the waste toner agitator 5 moves linearly in the agitator travel direction 22. Additionally, when the cam 11 contacts the cam slider 12*b*, the waste toner agitator 5 moves linearly in the agitator travel direction 20. When the cam 11 is kept rotating, the waste toner agitator 5 moves reciprocally in the agitator travel directions 20 and 22. As described above, the agitator drive gear 10 rotates counterclockwise in the configuration shown in FIG. 5.

With this movement, the waste toner in the waste toner container 4 is agitated and can be leveled, securing the capacity of the waste toner container 4. It is to be noted that the drive source 1 enters the low-velocity mode to form high quality images and the high-velocity mode to form standard quality images. In such a case, the waste toner is not agitated unless high quality images are formed. Therefore, after image position adjustment, which is executed at given constant intervals, the velocity of the drive source 1 is switched to the lower velocity and the cam 11 is driven, thus agitating the waste toner. Additionally, during the low-velocity mode (high quality mode), keeping the cam 11 driven constantly enables waste toner agitation without increasing the maximum output of the drive source 1 and can restrict the torque margin, which tends to increase in the low-velocity mode. As a result, generation of vibration and heat can be inhibited.

Fourth Embodiment

Figure 6:
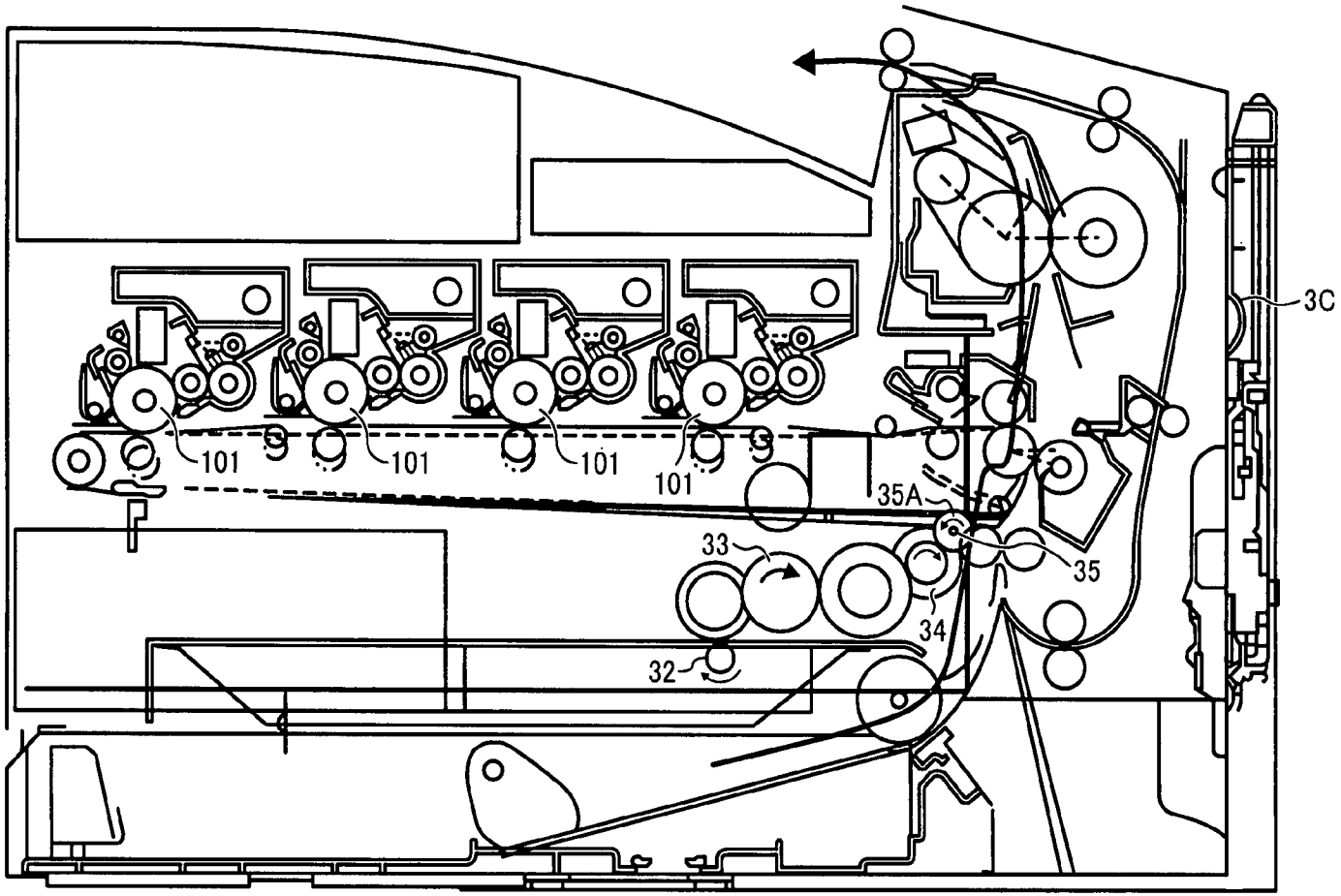
FIG. 6 is a cross-sectional view that illustrates configurations of an image forming apparatus according to a fourth embodiment and a drive transmission mechanism used therein.
Figure 7:
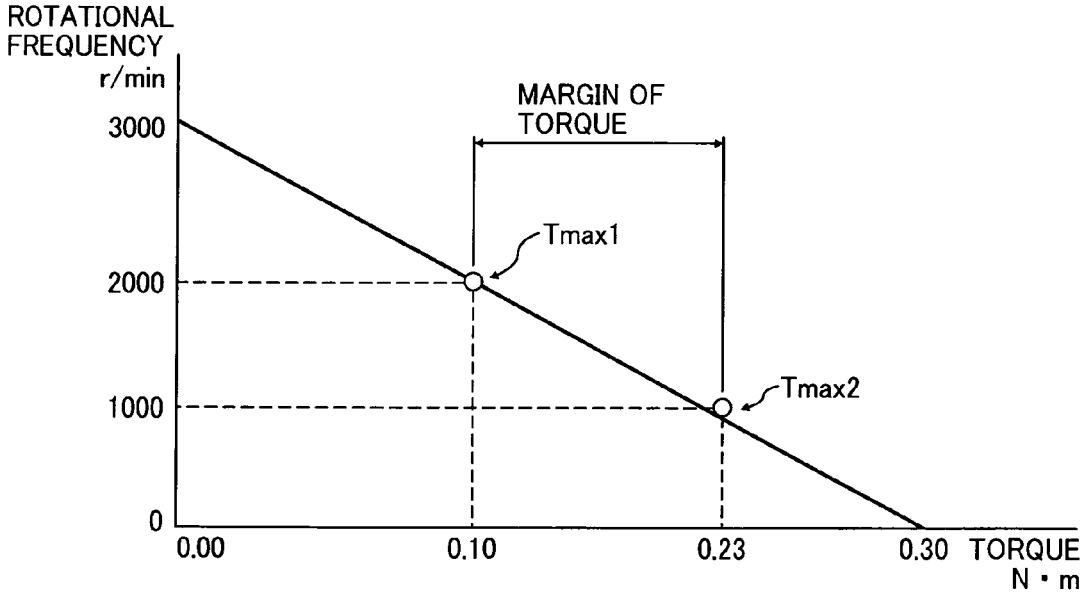
FIG. 7 is a graph that illustrates the relation between torque and frequency of rotation of a drive source used in the apparatus shown in FIG. 6 when the drive source is a brush motor, a brushless motor, or a stepping motor.

FIG. 6 is a diagram that illustrates configurations of an image forming apparatus according to a fourth embodiment and a drive transmission mechanism used therein, and FIG. 7 is a graph that illustrates the relation between torque and frequency of rotation of a drive source that may be a brush motor, a brushless motor, or a stepping motor.

Referring to FIG. 6, an image forming apparatus 3C includes a drive source 32, and the drive source 32 is connected to a registration shaft 35 of a registration roller 35A via a drive transmission unit 33 and an electromagnetic clutch 34. The drive source 32 may be a brushless motor, a brush motor, or a stepping motor. The registration roller 35A serves as a conveyance roller to transport sheets of recording media.

When the drive source 32 is rotated clockwise at a higher velocity of, for example, 2000 rpm in the high-velocity mode, the maximum allowable torque of the drive source 32 is, for example, 0.1 N·m as shown in FIG. 7. By contrast, when the drive source 32 is rotated clockwise at a lower velocity of, for example, 1000 rpm in the low-velocity mode, the maximum allowable torque of the drive source 32 is, for example, 0.23 N·m as shown in FIG. 7 and greater than that in the high-velocity mode. Thus, margin of the torque of the drive source 32 is excessive in the low-velocity mode. Accordingly, it is possible that the vibration caused by the drive source 32 is greater in the low-velocity mode than that in the high-velocity mode.

It is to be noted that the drive source 1 enters the low-velocity mode when the sheet is thicker or when high quality images are formed, and standard quality images are formed in the high-velocity mode. For example, when the sheet is thicker, the registration roller shaft 35 is driven at a low velocity and the force with which the sheet is clamped between the registration rollers 35A is increased from that in standard image formation. Accordingly, it is necessary to increase the torque of the registration roller shaft 35.

In other words, in the fourth embodiment, the registration shaft 35, serving as the driven unit, is driven at multiple different velocities and requires a greater torque when a velocity thereof is lower than when the velocity thereof is higher.

In view of the foregoing, the margin of the torque of the drive source 32 rotating at the lower velocity is used to increase the torque of the registration roller shaft 35 in the low-velocity mode. That is, to rotate the registration shaft 35 at the lower velocity, the drive source 32 rotates at the predetermined low velocity and drives the registration shaft 35 using a difference in torque of the drive source 32 between an upper limit torque in high velocity rotation and an upper limit torque in low velocity rotation, greater than the upper limit torque in high velocity rotation.

Thus, increases in the vibration in the low-velocity mode and transmission of it to the sheet transported can be restricted. Consequently, noise caused thereby can be restricted. Additionally, the required torque in the low-velocity mode can be secured.

Fifth Embodiment

Figure 8:
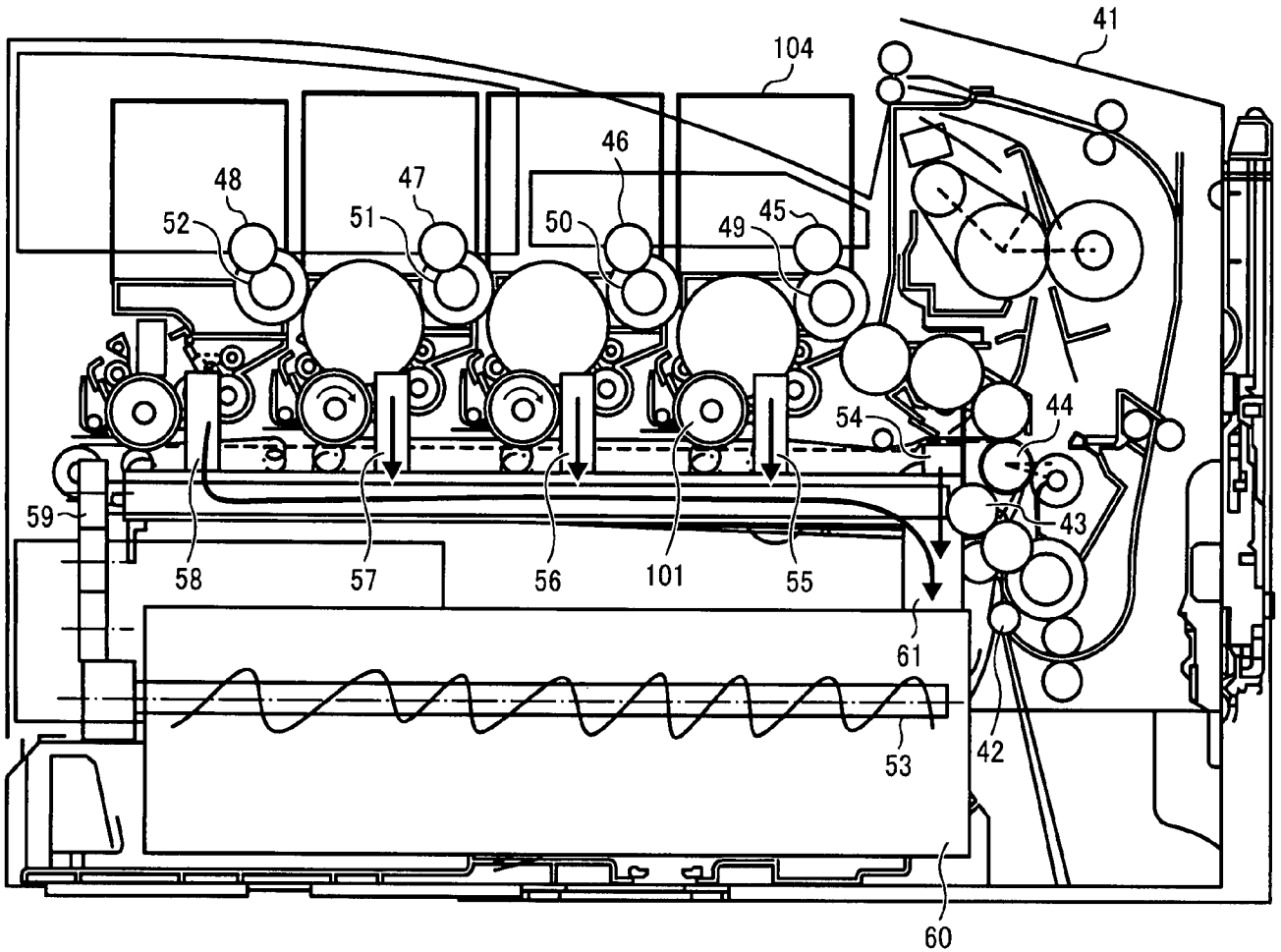
FIG. 8 is a cross-sectional view that illustrates configurations of an image forming apparatus according to a fifth embodiment and a drive transmission mechanism used therein.

FIG. 8 is a cross-sectional view that illustrates configurations of an image forming apparatus according to a fifth embodiment and a drive transmission mechanism used therein. More specifically, FIG. 8 illustrates the drive transmission mechanism for a toner supply system and a waste toner agitation system. The fifth embodiment is described below with reference to FIG. 8 as well as FIG. 7 used to describe the above-described fourth embodiment.

Referring to FIG. 8, an image forming apparatus 41 includes a drive source 42 to drive the toner supply system and the waste toner agitation system, and the drive source 42 is connected to a transfer drive shaft 44 via a drive transmission unit 43. The drive transmission unit 43 is further connected via a yellow electromagnetic clutch 49 to a yellow toner supply shaft 45, via a magenta electromagnetic clutch 50 to a magenta toner supply shaft 46, via a cyan electromagnetic clutch 51 to a cyan supply shaft 47, and via a black electromagnetic clutch 52 to a black toner supply shaft 48. The image forming apparatus 41 further includes supply toner containers 104 for containing respective color toners supplied to the development devices 102, and the toner supply shafts 45 through 48 may be shafts of rotary toner supply members, such as screws, provided inside the supply toner containers 104.

The drive transmission unit 43 is further connected via an agitation drive transmission unit 59 to a waste toner agitation shaft 53 provided in a waste toner container 60. The drive source 42 may be a brushless motor, a brush motor, or a stepping motor. The waste toner agitation shaft 53 may be a shaft of a rotary waste toner agitator, such as a screw, provided inside the waste toner container 60.

Similarly to the above-described fourth embodiment, when the drive source 42 is rotated clockwise at a higher velocity of, for example, 2000 rpm in the high-velocity mode, the maximum allowable torque of the drive source 42 is, for example, 0.1 N·m as shown in FIG. 7. By contrast, when the drive source 42 is rotated clockwise at a lower velocity of, for example, 1000 rpm in the low-velocity mode, the maximum allowable torque of the drive source 42 is, for example, 0.23 N·m and greater than that in the high-velocity mode. Thus, margin of the torque of the drive source 42 is excessive in the low-velocity mode. Accordingly, it is possible that the vibration caused by the drive source 42 is greater in the low-velocity mode than that in the high-velocity mode. It is to be noted that the low-velocity mode is required when the sheet is thicker or when high quality images are formed, and standard quality images are formed in the high-velocity mode.

When it is necessary to supply yellow, cyan, magenta, or black toner, the corresponding electromagnetic clutch 49, 50, 51, or 52 is turned on. Then, drive force is transmitted to the corresponding toner supply shaft 45, 46, 47, or 48, enabling toner supply.

The image forming apparatus 41 further includes a waste toner outlet 54 for waste toner collected from a transfer belt, a waste yellow toner outlet 55, a waste magenta toner outlet 56, a waste cyan toner outlet 57, and a waste black toner outlet 58. The waste toner is discharged to the waste toner container 60 through a waste toner conveyance duct 61 to which the waste toner outlets 54 through 58 are connected.

Because the toner supply shafts 45 through 48 are connected to the transfer drive gear 44, the toner supply shafts 45 through 48 are driven at a low velocity in high quality mode or when the sheet is relatively thick. Additionally, the waste toner agitation system including the waste toner outlets 55 through 58 operate similarly to the transfer drive gear 44, and the waste toner is transported at a low velocity in conjunction with transfer drive gear 44. At that time, the torque for driving the toner supply shafts 45 through 48 increases, and also the torque for transporting the waste toner increases as the velocity decreases.

In other words, in the fifth embodiment, the toner supply shafts 45 and the waste toner agitation shaft 53 together form a driven unit that is driven at multiple different velocities and requires a greater torque when a velocity thereof is lower than when the velocity thereof is higher.

The margin of the torque available when the drive source 42 rotates at the lower velocity is used for the increase in the torque required in the low-velocity mode. Therefore, increases in noise can be restricted, and the torque required in the low-velocity mode can be secured.

As described above, in the above-described embodiments, the configuration of the drive unit and torque adjustment thereof can be streamlined, reducing the number of control-related components, the required space, the cost, and adverse effects caused by excessive torque margin. Thus, a compact image forming apparatus can be provided at a reduced cost.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image forming unit including an image bearer on which images are formed and a development device to develop the image formed on the image bearer;

a first rotary shaft;

a second rotary shaft;

a drive unit to drive the first and second rotary shafts and including a drive source to rotate at a predetermined low velocity and a predetermined high velocity, a first rotary transmitter connected between the drive source and the first rotary shaft to transmit the drive force to the first rotary shaft, a second rotary transmitter connected between the drive source and the second rotary shaft to transmit the drive force to the second rotary shaft, and a drive block member connected between the drive source and the second rotary shaft, to block transmission of the drive force to the second rotary shaft when the drive source rotates at the predetermined high velocity, wherein, when the drive source rotates at the predetermined low velocity, the drive unit drives the second rotary shaft using a difference in torque of the drive source between an upper limit torque in high velocity rotation and an upper limit torque in low velocity rotation, greater than the upper limit torque in high velocity rotation.

2. The image forming apparatus according to claim 1, wherein the first rotary shaft is a rotary shaft of the image bearer.

3. The image forming apparatus according to claim 1, further comprising:

a waste toner container for containing waste toner; and a waste toner agitation unit provided within the waste toner container to agitate the waste toner in the waste toner container, the waste toner agitation unit including a waste toner agitator and a cam to drive the waste toner agitator, wherein the second rotary shaft is a cam shaft to which the cam is fixed.

4. The image forming apparatus according to claim 3, wherein the waste toner agitation unit further comprises a cam slider connected to the waste toner agitator and positioned to contact the cam when the cam rotates, and the waste toner agitator is moved by the cam slider when the cam is rotated.

5. The image forming apparatus according to claim 1, further comprising a supply toner container for containing toner supplied to the development device, wherein the second rotary shaft is a shaft of a rotary toner supply member to supply toner from the supply toner container to the development device.

6. The image forming apparatus according to claim 1, wherein the drive block member comprises an electromagnetic clutch.

7. The image forming apparatus according to claim 1, wherein the drive source rotates clockwise.

8. The image forming apparatus according to claim 1, wherein the drive source rotates counterclockwise.

9. The image forming apparatus according to claim 1, wherein the second rotary shaft rotates clockwise.

10. The image forming apparatus according to claim 1, wherein the second rotary shaft rotates counterclockwise.

11. The image forming apparatus according to claim 1, further comprising an idler gear provided between the drive source and the first rotary shaft.

12. An image forming apparatus comprising:

an image forming unit including an image bearer on which an image is formed and a development device to develop the image formed on the image bearer;

a driven unit driven at multiple different velocities, the driven unit requiring a greater torque when a velocity thereof is lower than when the velocity thereof is higher; and a drive unit to drive the driven unit and including:

a drive source to rotate at a predetermined low velocity and a predetermined high velocity, and a drive transmission unit connected between the drive source and the driven unit, to transmit a drive force from the drive source to the driven unit, wherein, when the drive source rotates at the predetermined low velocity, the drive unit drives the driven unit using a difference in torque of the drive source between an upper limit torque in high velocity rotation and an upper limit torque in low velocity rotation, greater than the upper limit torque in high velocity rotation.

13. The image forming apparatus according to claim 12, wherein the driven unit comprises a rotary shaft of a conveyance roller to transport sheets of recording media, the rotary shaft connected to the drive transmission unit.

14. The image forming apparatus according to claim 12, further comprising a waste toner container for containing waste toner, wherein the driven unit further comprises a rotary shaft to move a waste toner agitator provided within the waste toner container to agitate the waste toner in the waste toner container, the rotary shaft connected to the drive transmission unit.

15. The image forming apparatus according to claim 12, further comprising a supply toner container for containing toner supplied to the development device, wherein the driven unit comprises a rotary shaft of a rotary toner supply member positioned inside the supply toner container to supply toner from the supply toner container to the development device.

16. The image forming apparatus according to claim 12, wherein the drive source comprises one of a brushless motor, a brush motor, and stepping motor.

17. The image forming apparatus according to claim 12, wherein the drive transmission unit comprises a first gear fixed to a rotary shaft of the drive source and a second a gear fixed to a rotary shaft of the driven unit.

18. The image forming apparatus according to claim 12, wherein the drive source rotates clockwise.

19. The image forming apparatus according to claim 12, wherein the drive source rotates counterclockwise.

20. A method of driving a driven unit requiring a greater torque when a velocity thereof is lower than when the velocity thereof is high by a drive source rotatable at a predetermined low velocity and a predetermined high velocity, the method comprising:

rotating the drive source at the predetermined low velocity;

transmitting a drive force from the drive source to the driven unit; and driving the driven unit using a difference in torque of the drive source between an upper limit torque in high velocity rotation and an upper limit torque in low velocity rotation greater than the upper limit torque in high velocity rotation when the drive source rotates at the predetermined low velocity.

* * * * *